United States Patent [19]

Camardella

[11] 4,173,312

[45] Nov. 6, 1979

[54] NUMERICALLY CONTROLLED COIL WINDING MACHINE

[76] Inventor: Giuseppe Camardella, Via Miola, 1, 21047 Saronno (Varese), Italy

[21] Appl. No.: 852,791

[22] Filed: Nov. 18, 1977

[30] Foreign Application Priority Data

Nov. 24, 1976 [IT] Italy ..... 29698 A/76

[51] Int. Cl.[2] ..... H01F 41/02

[52] U.S. Cl. ..... 242/7.11; 140/92.1

[58] Field of Search ..... 242/7.09, 7.11, 7.14; 140/92.1

[56] References Cited

U.S. PATENT DOCUMENTS

| | | | |
|---|---|---|---|
| 2,855,159 | 10/1958 | Mallina | 242/7.11 X |
| 3,402,903 | 9/1968 | Camardella | 242/158.5 |
| 3,410,317 | 11/1968 | Rondas | 242/7.09 |

*Primary Examiner*—Billy S. Taylor

*Attorney, Agent, or Firm*—Young & Thompson

[57] ABSTRACT

A turret coil winding machine, having a turret comprising a plurality of support positions for the coils to be wound, these positions being uniformly distributed along its periphery, the turret being moved stepwise relative to a plurality of fixed working stations uniformly distributed about the periphery of the turret. Each of the support positions comprises a support member carrying a plurality of coil supports and mounted movably in the vertical plane along the Y and Z directions. A numerical control unit, the outputs of which are constituted by a pair of interconnected sliders movable along the Y and Z axes, is provided in at least one of the fixed working stations. A releasable coupling is associated with the coil support member for temporarily connecting the support member to the interconnected sliders.

4 Claims, 3 Drawing Figures

NUMERICALLY CONTROLLED COIL WINDING MACHINE

BACKGROUND OF THE INVENTION

1. Field of the Invention

This invention relates to a numerically controlled coil winding machine for manufacturing coils for electronic use. More particularly, this invention relates to a turret coil winding machine in which the wire winding guide is driven in known manner to rotate about the X axis and to slide along the same X axis, while the winding support is made to slide along the Y and Z axes under numerical control, to enable several separate winding mutually spaced apart on said support to be formed.

2. Description of the Prior Art

It has been known for some time to use numerical control in machine tools, for example milling, boring and drilling machines and the like. The principle on which this numerical control operates is therefore widely known, and it is consequently considered unnecessary to illustrate it in this description.

Relatively recently it has been proposed to apply numerical control to machines operating in the electronic component production field. One example of such an application is in the mass production of printed circuits, in which the various perforations in the printed circuit are made in accordance with a predetermined circuit diagram by several drilling bits operating in parallel, their position relative to the printed circuits being determined by numerical control. Likewise, numerical control has been applied to trimming integrated circuits, and only recently has it been considered for coil winding.

In this latter case, coil winding machines are known in which several coil supports are fixed on a support plate disposed in a horizontal or vertical plane, the plate being moved in this plane in two perpendicular directions. This plate movement is used to cause the axes of the individual coil supports to each coincide in succession with the axis of the wire guide which effects the winding.

A coil winding machine based on this operating concept is evidently conceived with the purpose of obtaining a high productivity rate, in that besides producing several windings simultaneously, it eliminates a large part of the down times necessary for the mechanical replacements required in known machines, it being necessary in this case to change only a punched or magnetic tape.

However, this machine has a limited use mainly because it is able to make only one winding or additionally, at the most, to twist together the coil terminals, these being operations which may both be performed by the same wire guide, in accordance with a predetermined winding programme.

If however it is required to produce a somewhat more complicated coil, for example a coil with two superimposed windings of different characteristics, it is impossible to produce this automatically with the aforesaid numerically controlled machine.

In this respect, with such a machine it is necessary to remove the coil after the first winding and start again for each subsequent winding, thus considerably reducing productivity. It must be remembered that in this machine, the times required for loading and removing the workpieces are effectively down times because the machine is at rest during these stages.

In the coil winding field, turret coil winding machines, with which completely finished complicated coils may be obtained, are much more widely used.

These machines are based on a different operating concept. The empty coil supports are loaded on to support pins which project radially from support positions in a machine turret which rotates stepwise, and are transferred in succession through various fixed working stations in the machine. These stations may each execute one of the required operations, namely the basic winding operation preceded and/or followed by winding the terminals, then the complementary stages of soldering the terminals, waxing, taping or the like, then possibly a second winding, and so on.

In these machines, each support position on the turret comprises either only one support pin with only one wire guide in each winding station, or as many support pins as there are wire guides in each winding station. Up to the present time it has not been felt necessary to combine both the aforesaid operating concepts in a single machine, i.e. to provide a turret coil winding machine in which a support plate, capable of supporting a number of coils equal to a multiple of the number of wire guides, is associated with each support position, as a replacement for the support pin or pins. In effect, this would create a machine in which, not only would the turret have to be moved to shift each support position through the successive working stations so as to stop it in a single well determined position in each working station, but in addition said support plate would, in some way or another, have to be moved relative to the respective support position, so as to be placed in different pre-established positions in each working station. In reality:

on the one hand, it was not evident what advantages could be obtained from a method of this type compared with a normal turret coil winding machine, considering that the production rate would be increased by an insignificant amount. In this respect, the down times involved in loading and removing the coils would be contained within the winding times (seeing that in turret machines, the loading in any given station is being carried out at the same time as the winding in another station), and the down times involved in moving the coil supports from one working station to another would be comparable to the times involved in moving and positioning a support plate for several coils in front of the wire guide, even in a numerically controlled machine;

on the other hand, even if some small productivity advantage could be envisaged in a machine of this construction, the complication of conceiving a support plate movable along the Y and Z axes, the cost of a numerical control unit associated with each turret position to govern such a movement, and the difficulty of making the connection between the movable turret position and the necessarily fixed numerical control unit have discouraged such an application up to the present time.

However, the requirement has arisen in recent times for an assembly consisting of several identical interconnected electrical coils formed into an inseparable complete unit. An assembly of this type is required for example in telephone exchanges, and generally comprises a baseplate on which several identical coils, each formed from two superimposed windings, are disposed for example in a number of perpendicular rows and columns.

The constructional method used at present for making this assembly is to utilise identical coils from any mass production, and then connect them suitably together.

SUMMARY OF THE INVENTION

The object of the present invention is to construct a coil assembly of the aforesaid type as a complex finished unit in a turret coil winding machine, in which the coils are wound on a plurality of coil supports which are integral with a common support plate.

A further object of the present invention is to provide a coil winding machine able to operate in accordance with the two aforesaid operational concepts, i.e. a turret machine in which a support member carrying a plurality of coil supports and which can slide along the Y and Z axes, is associated with each turret working position, and in which the said sliding movements may be numerically controlled by simple and economical means.

These and further objects are attained according to the present invention by a turret coil winding machine in which each of the said support positions on the turret is moved stepwise into successive fixed stations of the coil winding machine, wherein with each support position on the turret there is associated a fixing stirrup for the holding plate of the coil supports, and a pair of slides slidable on two respective guides disposed along the Y and Z axes, a first of said guides being integral with the turret, while a second guide is integral with the slide slidable on the first guide, said fixing stirrup being integral with the slide carried by the second guide, and wherein a numerical control unit, the outputs of which are constituted by a pair of interconnected sliders mobile along the Y and Z axes, is provided in at least one of the fixed working stations of the machine, said slides each being provided with releasable coupling means for connecting and fixing said slides each to one of said interconnected sliders.

BRIEF DESCRIPTION OF THE DRAWING

Further characteristics and advantages of the machine according to the present invention will be evident from the description given by way of example of a preferred embodiment illustrated in the accompanying drawings in which.

DESCRIPTION OF THE PREFERRED EMBODIMENT

Figure 3:
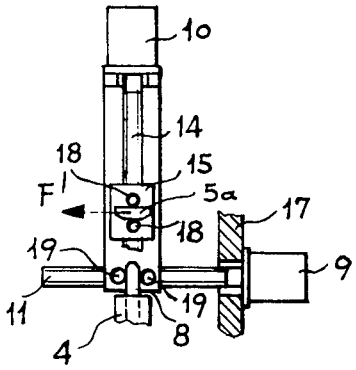
FIG. 3 is a front view along the arrow F of FIG. 1, showing the two interconnected sliders for the numerical control operation.

As shown, the coil winding machine according to the present invention comprises in known manner a fixed base on which a turret is rotatably mounted, of which only the rotating table 1 is shown.

The bracket 2, representing the support position fixed to the turret, is fixed on the rotating table 1. Although only one bracket 2 is shown on the drawing, it is evident that such a bracket, together with the entire assembly associated therewith as shown on the drawing and described hereinafter, is provided in each support position I to VI on the turret, and is the same in each case. In this respect, the number of support positions on the turrets of modern coil winding machines range from a minimum of two to a maximum of eighteen or more, distributed uniformly along their periphery.

According to the invention, a first guide 3 is disposed horizontally along the Y axis is fixed to the bracket 2. A first slide 3A is slidable on this guide. On the drawing, the connection between the guide 3 and slide 3A is shown as a dovetailed arrangement, but in practice a sliding system of known type will be used allowing a smooth and very precise movement of the slide 3A on the guide 3.

A second guide 4, disposed vertically along the Z axis, is provided integral with the slide 3A. A second slide 5 is slidable on the guide 4.

The slide 5 forms the connection and fixing support member for a support plate 6 of a plurality of coil supports *6a*, on each of which a coil is to be wound.

The coils are wound on the supports *6a* by the winding head 7, also shown very diagrammatically, by means of a series of wire guides *7a* operation in parallel, which are slidable along the X axis and rotatable about said axis. The group of parallel wire guides *7a* is shown here only by way of example, and the operation could obviously be performed by a single wire guide using a substantially known method which does not form part of the invention.

With reference to the assembly formed by the slides 3A and 5, according to the invention, a tooth *5a* projecting towards the central axis or interior of the machine is integral with the upper end of the slide 5, and is of elongated shape in a horizontal direction, and may be provided with bevelled end edges to form a lead-in.

An arm *4a* is integral with the assembly formed by the slide 3A and guide 4, and extends towards the interior of the machine, passing above the guide 3. At its inner free end, the arm *4a* carries a vertically mobile latch 8. In its lowered position, the latch 8 is arranged to engage in a corresponding seat formed by the forked plate *8a*, integral with the bracket 2, to lock the slide 3A on the guide 3.

The assembly constituted by the guides and slides 3, 3A, 4 and 5, plus the additional elements *5a*, *4a*, 8 and *8a*, forms a unit which, as stated, is provided for each support position on the turret, i.e. on the rotating table 1. This unit is moved in succession through the various fixed stations of the machine. In one of these fixed stations, or possibly in more than one station, there is provided a winding head unit 7, *7a*.

In the station which comprises the winding head 7, a numerical control unit operates for controlling the movements of the plate 6, by means of the slides 3A and 5. The entire control assembly is shown only diagrammatically, as its structure does not form part of the present invention, and is already well known.

The drawing in fact shows the following components, forming part of the numerical control unit:

- a first stepping motor 9 and a second stepping motor 10, on which the numerical control operates directly, to cause them to rotate in one direction or the other through programmed angles of rotation;
- a first screw 11 driven by the motor 9 to drive a respective nut housed in a first slider 12. The screw 11 is disposed horizontally, and the slider 12 is thus movable along the Y axis;

a second screw 14, driven by the motor 10 to drive a respective nut housed in a second slider 15. The screw 14 is disposed vertically, so that the slider 15 is movable along he Z axis;

an interconnecting support member 16, integral with the slider 12 and supporting the motor 10, screw 14 and slider 15. The motor 9 is mounted on a support frame of which only the plate 17 is shown diagrammatically, this frame being fixed on the base of the coil winding machine.

As stated, the drawing is very diagrammatic in order to show only those parts concerned with the present invention, and because of this the configuration of the frame 17 is not shown in detail. Likewise, the screws 11 and 14 are shown projecting cantilevered from the respective supports 17 and 16, but their construction will obviously be more complex and stable, in order to ensure high precision of movement of the two slides 3A and 5.

Each of the two sliders 12 and 15 is also provided, according to the present invention, with coupling means for rigidly connecting the sliders with the slides 3A and 5 respectively.

In the case of the slider 15, said coupling means consist simply of a pair of overlying stops in the form of two rollers 18, the pins of which are vertically overlying and with their axes horizontal, and perpendicular to the plane of the plate 6, i.e. positioned along the X axis. As shown on the drawing, the tooth 5*a* of the slide 5 engages between these two rollers. As the slider 15 moves only in a vertical direction, and likewise the slide 5 moves only vertically, the engagement between the rollers 18 and tooth 5*a* is sufficient to ensure a positive connection between the slider 15 and slide 5.

In the case of the slider 12, said coupling means consist of a seat for receiving the upper end of the latch 8. This seat is preferably formed by a pair of rollers 19, the pins of which have their axes horizontal and perpendicular to the plate 6, and lying side-by-side in a horizontal direction. The upper end of the latch 8 becomes engaged between these two rollers when it is raised, as indicated hereinafter. Because the slider 12 moves only horizontally, and the slide 3A moves likewise only horizontally, the engagement between the rollers 19 and latch 8 is sufficient to ensure a positive connection between the slider 12 and slide 3A.

It should also be noted that:

when the slider 15 moves vertically, it drags the slide 5, and this movement has no influence on the slide 3A, on which the slide 5 can slide freely;

when the slider 12 makes a horizontal movement, it drags the slide 3A. This movement is transmitted to the slide 5, which in its turn becomes dragged horizontally, but in addition it also moves the assembly comprising the slider 15, screw 14 and motor 10, which is interconnected with the slider 12 via the interconnecting support member 16. Thus there is no risk of the tooth 5*a* disengaging from the rollers 18 in view of the horizontal movement of the slide 5.

Consequently, the numerical control unit is able to control perfectly the horizontal and vertical movements of the plate 6, via the motor 9, slider 12 and slide 3A, and the motor 10, slider 15 and slide 5 respectively.

Figure 1:
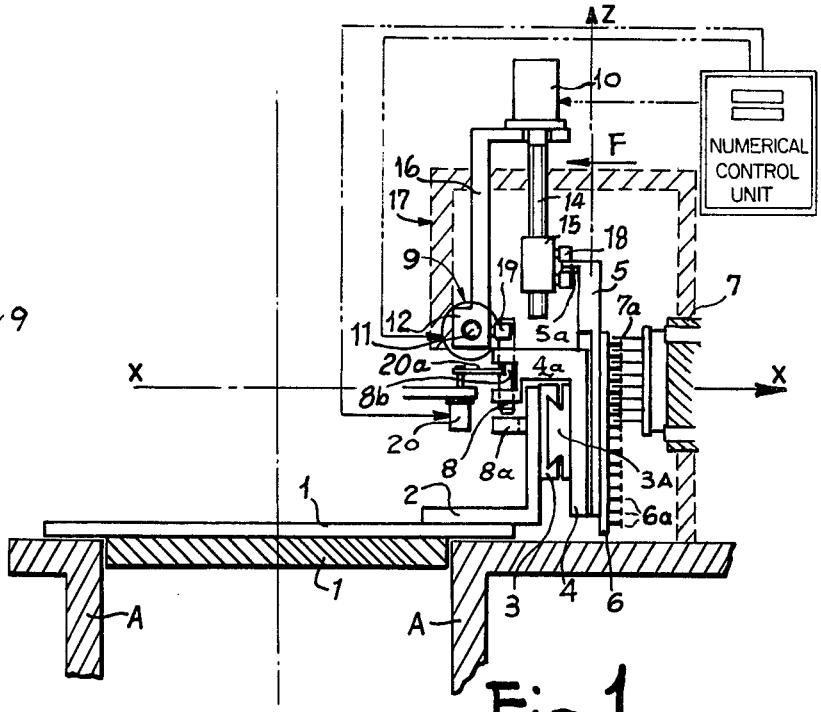
FIG. 1 is a very diagrammatic general arrangement of a fixed working station of a turret coil winding machine, in which a device is incorporated for controlling the movements of the coils support plate along the Y and Z axes, in accordance with the present invention.
Figure 2:
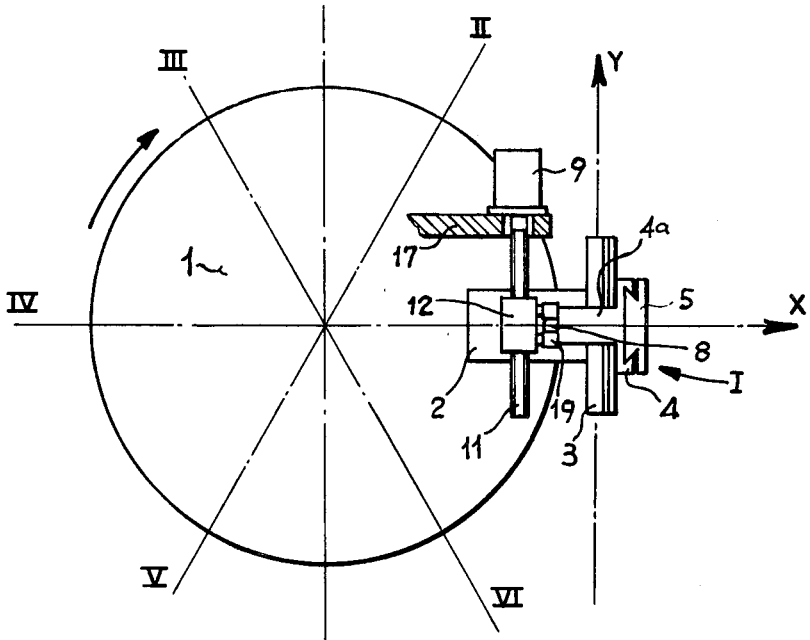
FIG. 2 is a very diagrammatic view from above of the assembly of FIG. 1.

The plate 6 is brought into an initial working position, for example the position shown in FIG. 1, in which a first group of coil supports 6*a* is positioned relative to the axes of rotation of the wire guides 7*a*. These latter can then make the windings, while the plate 6 remains fixed.

After winding a first group of coils, the plate 6 is moved under numerical control to position a new group of supports 6*a* in front of the wire guides 7*a*.

After winding all the coils, the plate 6 is returned to its zero position, which is necessary, as will be explained, for the further correct operation of the machine. This zero position corresponds to the position in which the slide 3A is centered relative to the guide 3, i.e. the axis of the latch 8 integral therewith coincides with the axis of the seat 8*a*, and in which the slide 5 is in its lowest position, resting against a fixed limit stop, not shown, integral with the guide 4.

It will be assumed that this zero position is that shown in the figures. When the slides have been brought into this position after winding all the coils, the latch 8 is lowered to engage in the seat 8*a*. This movement of the latch 8 is induced by the arm 20*a*, which is controlled by a pneumatic cylinder 20 or some other like control, for example an electromagnet.

In its descent, the latch 8 engages in the seat 8*a*, so locking the arm 4*a* and making the assembly constituted by the slide 3*a* and guide 4 integral with the bracket 2, without any further horizontal movement being possible. In this descent movement, the latch 8 simultaneously disengages from the rollers 19, thus releasing the slider 12 from the slide 3A.

At this point, the rotating table 1 is free to move through one step together with the turret and the support position shown, all the other identical support positions also moving through one step. The numerical control unit, and in particular its output elements 9, 11, 12 and 10, 14, 15 remains instead at rest however, in the working station in which the winding head 7, 7*a* is situated.

The rotating table is able to move into the described zero position not only because the latch 8 is released from the rollers 19 of the slider 12, but also because the tooth 5*a*, due to its configuration and horizontal arrangement, becomes free from following the movement of the rotating table in the peripheral direction, by disengaging laterally from the rollers 18 in the same direction F′ (see FIG. 3) as the rotating table.

It is obvious that in the same manner in which the tooth 5*a* of the slide 5 of any given support position disengages from the rollers 18 of the numerical control unit, the tooth 5*a* of a successive support position—and which is in the zero position, having previously left the winding station—becomes inserted between the rollers 18, facilitated by the lead-in formed by the bevelled edges of the tooth 5*a* itself.

When a successive support position on the turret has reached the winding station and the tooth 5*a* associated with its slide 5 has automatically become inserted between the rollers 18, the cylinder 20 is operated in the opposite direction, the arm 20*a* is raised and the latch 8 associated with this new support position engages between the rollers 19, to provide the connection with the numerical control slider 12.

The connection between the operating end of the arm 20*a* of the control 20, which is fixed in the winding station, and the latch 8 integral with the support position, which is movable with the turret, is made in a manner analogous to the connection between the rollers 18 and tooth 5*a*, in that a horizontally extending notch 8*b* is provided in the latch 8, in which the arm 20*a* engages.

The invention is not limited to the embodiment shown, which is very diagrammatic and is to be considered purely indicative and given by way of example only. All possible modifications available to an expert in the art may be made thereto, without leaving the scope of the inventive idea. In particular, the arragement of the horizontal guide integral with the bracket 2 and vertical guide integral with the horizontal slide is not binding, and a reverse arrangement could be used.

I claim:

1. A turret coil winding machine, comprising a turret, means mounting the turret for indexing rotative movement about a vertical axis, a plurality of brackets on the turret distributed about the periphery of the turret, a plurality of fixed work stations surrounding the turret, whereby the brackets on the turret can be brought sequentially into registry with the work stations by indexing movement of the turret, a plurality of coil supports, means mounting each said coil support for sliding movment on and relative to a said bracket in two orthogonal directions in a vertical plane, and a numerical control unit for controlling a work operation in at least one said work station, said unit having an output comprised by means for moving a said coil support in said at least one work station in said two orthogonal directions, and detachable coupling means for releasably fixing the position of said coil supports relative to said brackets.

2. A machine as claimed in claim 1, said means mounting each said coil support for sliding movement on and relative to a said bracket comprising a first slide to which the coil support is fixed, a second slide on which the first coil support slides in one orthogonal direction, said second slide sliding in the other orthogonal direction on said bracket.

3. A machine as claimed in claim 2, said numerical control unit comprising means to move said first side relative to said second slide and to move said second slide relative to said bracket, said detachable coupling means releasably fixing the position of said second slide relative to said bracket.

4. A machine as claimed in claim 3, said detachable coupling means also selectively disabling said means for moving said second slide relative to said bracket.

* * * * *